US005456353A

United States Patent [19]

Challoner et al.

[11] Patent Number: 5,456,353

[45] Date of Patent: Oct. 10, 1995

[54] CARRIER BAG FOR ATHLETIC BOOTS

[76] Inventors: Audrey Challoner, 399 W. Broadway, Apt. 4, New York, N.Y. 10012; Michael Swick, 53 W. 70, 3A, New York, N.Y. 10023

[21] Appl. No.: 233,979

[22] Filed: Apr. 28, 1994

Related U.S. Application Data

[63] Continuation of Ser. No. 939,158, Sep. 2, 1992, Pat. No. 5,390,786.

[51] Int. Cl.[6] ..... B65B 85/18

[52] U.S. Cl. ..... 206/292; 206/315.1; 383/39

[58] Field of Search ..... 280/814, 825; 383/38, 39, 46; 206/278, 292, 294, 315.1

[56] References Cited

U.S. PATENT DOCUMENTS

| | | | |
|---|---|---|---|
| 293,626 | 2/1884 | Bunker . | |
| 312,726 | 2/1885 | Johnston . | |
| 1,818,030 | 8/1931 | Arnold | 383/40 |
| 2,276,765 | 3/1942 | De Gree | 206/278 |
| 2,497,325 | 2/1950 | Scherba | 206/278 |
| 2,609,897 | 9/1952 | Meyer | 206/278 X |
| 2,712,337 | 7/1955 | Tremblay | 206/292 X |
| 2,834,460 | 5/1958 | Lee, Jr. et al. | 206/292 |
| 3,327,924 | 6/1967 | Brutting | 383/38 X |
| 3,348,665 | 10/1967 | Andretich | 206/315.1 |
| 3,600,734 | 8/1971 | Pollinger | 12/120.5 |
| 3,608,795 | 9/1971 | Klein et al. | 224/45 R |
| 3,721,373 | 3/1973 | Penniman | 224/45 S |
| 3,749,232 | 7/1973 | Craig | 280/814 X |
| 3,794,226 | 2/1974 | Penniman | 224/45 S |
| 3,963,103 | 6/1976 | Cowen, III | 206/315.1 |
| 4,126,255 | 11/1978 | Olson | 224/45 S |
| 4,126,256 | 11/1978 | McGruder | 383/38 X |
| 4,152,002 | 5/1979 | Olson | 280/11.37 R |
| 4,244,498 | 1/1981 | Copp | 224/45 P |
| 4,358,137 | 11/1982 | Gramm | 280/814 |
| 4,537,436 | 8/1985 | Pfortmiller | 294/150 |
| 4,629,103 | 12/1986 | Miller | 224/250 |
| 4,696,504 | 9/1987 | Roberts, Jr. | 294/148 |
| 4,761,029 | 8/1988 | Woodcock | 294/148 |
| 4,790,462 | 12/1988 | Kawaguchi | 224/250 |
| 4,815,642 | 3/1989 | Ray | 224/258 |
| 4,817,306 | 4/1989 | Bayer | 36/136 |
| 4,819,795 | 4/1989 | Swaney | 206/278 |
| 4,848,782 | 7/1989 | Schmidt | 190/18 A |
| 4,856,689 | 8/1989 | Shore | 224/218 |
| 4,881,637 | 11/1989 | Peters et al. | 206/278 |
| 4,917,290 | 4/1990 | Saiki et al. | 229/112 |
| 4,942,994 | 7/1990 | Sterenberg | 224/247 |
| 5,012,921 | 5/1991 | Becker | 206/315.1 |

*Primary Examiner*—Jacob K. Ackun

[57] ABSTRACT

A carrier bag for carrying a pair of athletic boots. The carrier bag has a compartment for storing the pair of boots and a retainer for securing the boots inside the compartment in an inverse, planar relationship to eachother.

6 Claims, 4 Drawing Sheets

CARRIER BAG FOR ATHLETIC BOOTS

This is a continuation of application Ser. No. 07/939,158, filed Sep. 2, 1992, now U.S. Pat. No. 5,390,786.

BACKGROUND OF THE INVENTION

The field of the present invention is carrier bags for athletic shoes and more specifically, for bulky athletic boots such as in line skates, roller skates, ice skates, ski boots and the like.

Recreational and competitive skaters and skiers are always looking for convenient ways to carry or transport their athletic shoes and boots when they are traveling to the skating rink, ski slope, or park. Many of these carrying apparatus are quite versatile and can be used interchangeably to carry many types of athletic and walking shoes. Each has its advantages and disadvantages and is generally selected to suit the particular needs of the user. However, what becomes evident from a brief description of some of these carrying apparatus is that there is a need for a convenient carrying bag that not only holds the athletic shoes in a compact and nonshifting relationship, but also leaves the users hands free to carry other items or to help retain his balance while skating.

Ski boots, probably the largest, heaviest and most cumbersome the various athletic shoes are typically carried in a large "top-entry" bag that provides ample space to permit a pair of individual boots to sit side-by-side in an upright position inside the bag. The problem with this bag is that it is designed to expand to the width of the two boots and becomes quite bulky, large and awkward to carry. Alternatively, a pair of ski boots is carried on a ski boot carrier which is a simple apparatus having a rope loop hanging from a small handle. The boot buckles are threaded through and snapped shut around the rope such that the boots are secured to the rope allowing the skier to grasp the handle and carry both boots in one hand. Like the ski boot bag, the ski boot carrier is awkward to use because the boots hang side by side taking up a lot of area. To make matters worse, the ski boot carrier does not hold the boots in a non-shifting relationship to eachother. Each boot is allowed to swing freely making it difficult to control or retard their movement and prevent them from banging against other hard objects, the carrier's leg and other people passing by. Because the athletic boots are constructed of very hard material, the constant swinging and banging motion experienced can be very painful and leave bruises.

Another problem with the ski boot carrier is that it does not cover and protect the boots. As a result, the unprotected boots can be easily scratched or damaged as they bang against eachother and other hard objects during transport. In addition, the ski boot carrier does not protect the boots from the snow, slush and other elements. At a minimum, the inside of the boots may become wet and cold making them uncomfortable to wear and, at a maximum, can be damaged due to warping. The awkward and bulky nature of both the ski boot bag and the ski boot carrier are most readily apparent and amplified when the user is also lugging around skis, poles and suitcase through a crowded airport during ski season.

Similar carrier bags and devices are used to transport roller skates, in line skates, and ice skates; and, like the ski boot bag and carrier, they have various deficiencies and drawbacks. The most popular means for carrying skates is to tie the shoe laces together and hang them from the carrier's shoulder. As any skater knows, this method for carrying skates is awkward for at least two reasons—the skates swing and bounce off the carrier's back and chest as he walks and the weight of the skates causes the laces to dig into the carrier's shoulder, both of which are painful experiences. The concept of hanging a pair of boots from the carrier's shoulder was applied to the design of a bag described in U.S. Pat. No. 4,126,256 issued to McGruder. This bag, which can best be described as a saddle bag design, may overcome the problems caused by the laces digging into the carrier's shoulder. However, it does not solve the problem caused by the swinging and bouncing of the skates against the carrier's chest and back.

Another problem experienced by roller skaters, in line skaters, ice skaters and, to some extent, skiers is having no place to put their walking shoes when they are skating or skiing outdoors. If the skater decides to walk to a particular skating destination such as a park, bike trail, boardwalk, or frozen lake the skater must take off his or her shoes and either leave them somewhere where they can be picked up later, tie the shoe laces together and hang them from his or her neck or shoulder, or carry them in a handbag or knapsack. Each one of these methods offers its own problems. If a skater leaves her walking shoes laying around somewhere she runs the risk of having them stolen while she is skating. If a skater hangs them from her shoulder or carries them in her hand she loses some freedom of motion and concentration increasing the danger of falling. She loses the free use of her hands to keep her balance and must constantly readjust or balance her dangling shoes so that she does not drop them.

Along the same lines, if the skater falls while the shoes are hanging from her shoulder, she runs the risk of being injured by the shoes when she hits the ground. The shoes may hit her in the face when she falls or be caught under her in an unsafe position when she hits the ground. If the shoes are hanging from her neck, she may be choked, scratched or burned by the laces. Needless to say, a skater does not enjoy her skating experience as much as she would if her hands were free and she did not have to worry about where to keep her walking shoes while she skates.

Another problem experienced by skaters is that they are often not allowed in stores or restaurants wearing skates. Thus, skaters on a boardwalk, for example, are prohibited from shopping, browsing, going to the rest room, and the like unless she changes into a pair of walking shoes. Under these circumstances, a bag for carrying the skater's walking shoes is desired to insure that her walking shoes are available if she decides to stop to get something to eat or drink. In another sense, such a bag will expand the boundaries of the "skating rink." If a skater carries her walking shoes with her she has the option of skating greater distances without the worry of having to skate back the same distance on the return trip. If she gets tired of skating she can put on her walking shoes and take a bus, train or taxi back home.

Unfortunately, in order to avoid dealing with the above-mentioned problems, the roller skater or in line skater will, more often than not, leave her walking shoes home and skate to the park, bike trail, or boardwalk. However, in route from the skater's house to her skating destination the skater must confront and avoid a variety of urban obstacles such as stairs, curbs, people, stop lights, cars, dogs and dog leashes, and so forth. The inherent dangers that a skater is likely to encounter are quite numerous when one considers that the typical skater is not an expert skater having the skills required to easily avoid common obstacles. It is an all too familiar scene to see a novice skater grasping onto a telephone pole or traffic sign to avoid rolling out of control into the street. This is especially true for younger skaters who are influenced by television commercials exhibiting teams of in line skaters skating at high speeds through the streets of a city. As a result, parents are constantly warning their children to carry their skates and walk to their skating destination. Unfortunately, the burden of skating with something in your hands or around your neck (i.e., walking shoes) or of worrying whether you will be able to find your shoes where you left them before you started skating forces many skaters to expose themselves to the inherent dangers of skating in an unsafe skating environment in order to get to a safer skating environment.

One way to encourage safer skating habits is to provide a bag that will interchangeably accommodate a pair of skates and the skater's walking shoes when she is skating. Although knapsacks are typically used for this purpose they present a variety of problems. First, although just about all knapsacks will, in one way or another, accommodate a pair of walking shoes, it is usually difficult to find a knapsack that is large enough or shaped to accommodate a pair of ice skates, in line skates or roller skates. Second, when a large enough knapsack is found it is usually stressed and, eventually torn, where the wheels or blades press against the fabric because the blade portion is not held in a non-damaging position where it will not be stressed or pressed against the bag. Third, such bags do not hold the shoes or skates in a nonshifting relationship relative to eachother because the individual skates are not secured in place inside the bag. In other words, the individual skates or boots are allowed to slip or bunch up over eachother. Nor do such bags balance or distribute the weight of the skates inside the bag. Invariably the skates shift around inside the bag and eventually settle in an awkward disarray in positions in which they can be damaged and such that they hang uncomfortably from the wearer's back in at least two respects—first, the center of gravity of the boots is often too far away and unbalanced relative to the wearer's body and, second, the boots and blade portions thereon press out against the bag such that the bag does not rest comfortably against the wearer. The weight of the skates then causes protruding portions of the skates such as the wheels or blades to dig into the wearer's back even when she is standing still. The knapsack is even more uncomfortable when the wearer is walking and her motion causes the bag and the sharp portions of the skates to painfully bounce off her back.

SUMMARY OF THE INVENTION

The present invention is directed to a bag for carrying a pair of athletic boots such as in line skates, roller skates, ice skates, ski boots or other athletic shoes. To this end, a carrier bag comprising a shoe compartment having a retainer for securing a pair of shoes inside the compartment in an inverse and/or planar relationship to eachother is disclosed. A blade guide is also provided to position and hold the blade portion of the skates in a safe location relative to the wearer.

Accordingly, it is an object of the present invention to provide a carrier bag for athletic boots that will comfortably hold a pair of athletic boots in a non-shifting, planar and/or inverse relationship to eachother.

Another object of the present invention is to provide a carrier bag that will interchangeably hold either a pair of walking shoes or a pair of athletic boots in a compact and secure manner and accommodate an array of safety equipment and other skating accessories.

Another object of the present invention is to provide a carrier bag that will allow a skater to skate while safely carrying a pair of walking shoes secured closely to his back or, alternatively, allow the skater to walk while carrying a pair of athletic boots with sharp or blunt protruding portions of the blade positioned safely away from or relative to the skater's back.

Another object of the present invention is to provide a carrier bag having an opening to accommodate protruding portions of an athletic boot outside the bag to reduce the size of the bag and to hold the pair of athletic shoes in a tighter, more compact relationship to eachother.

Other and further objects and advantages of the disclosed invention will appear hereinafter.

DETAILED DESCRIPTION OF THE PREFERRED EMBODIMENT

Figure 1:
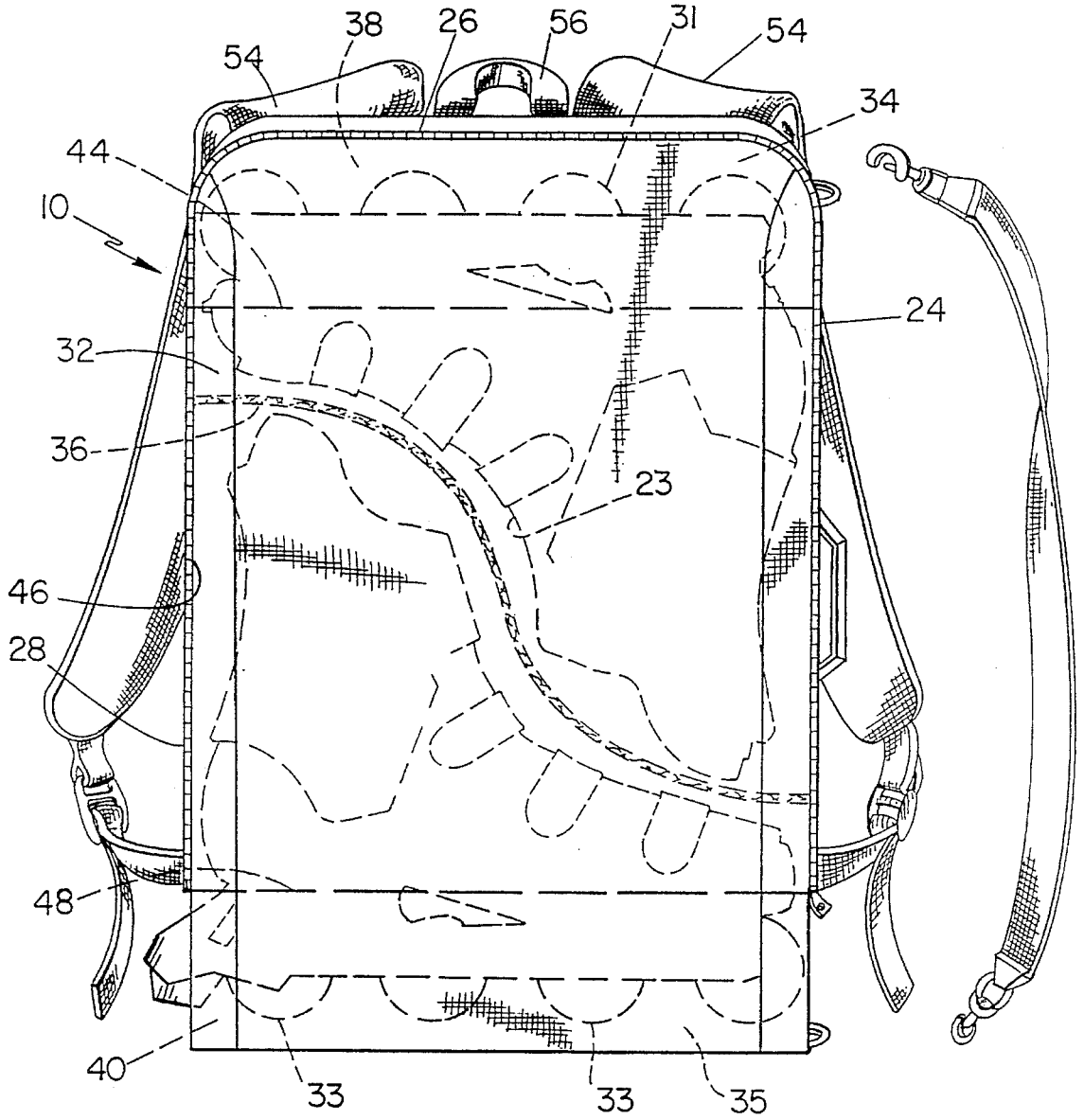
FIG. 1 is a perspective front view of the carrier bag in a closed position carrying a pair of in line skates.
Figure 2:
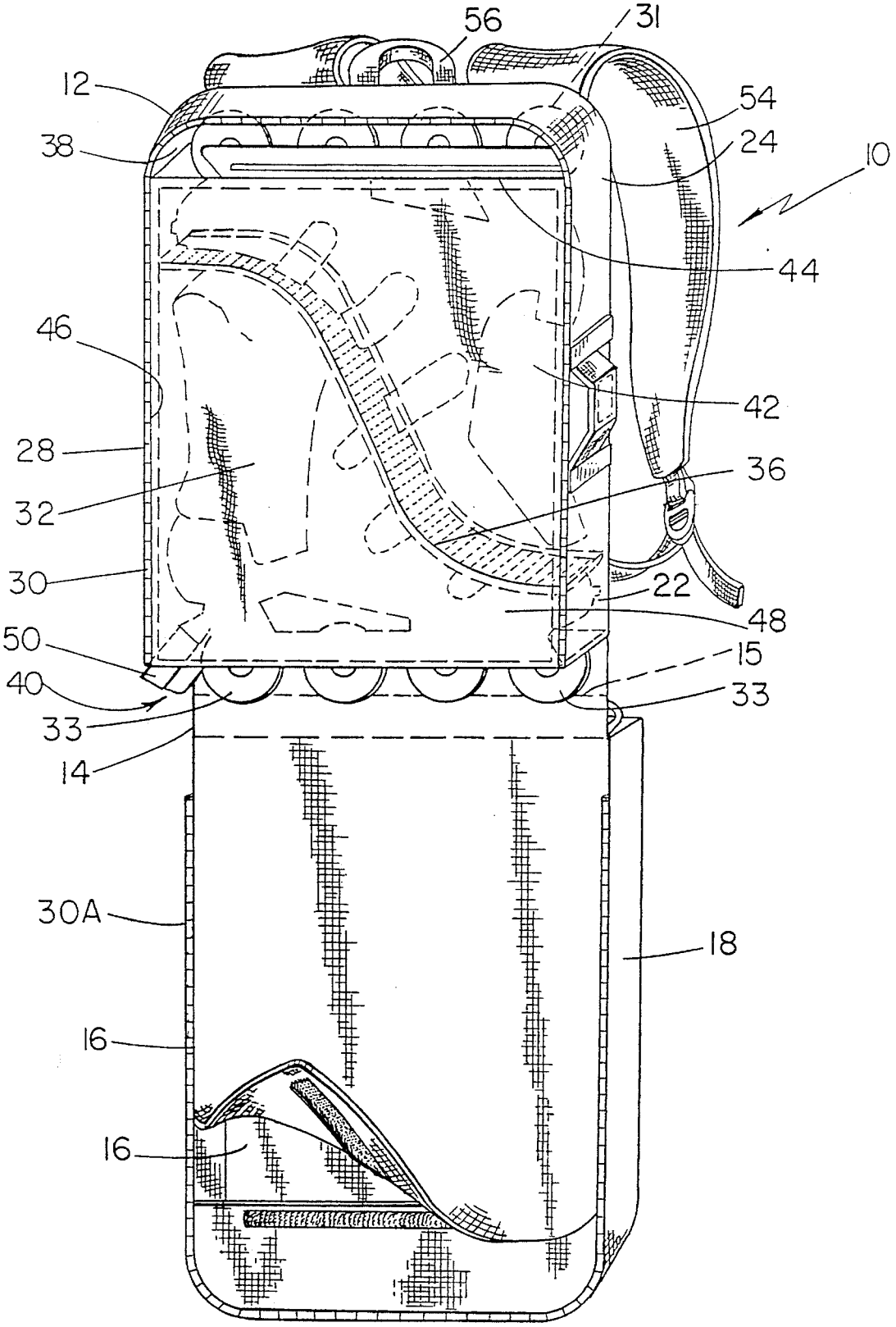
FIG. 2 is a perspective front view of the carrier bag in an open position carrying a pair of in line skates.
Figure 4:
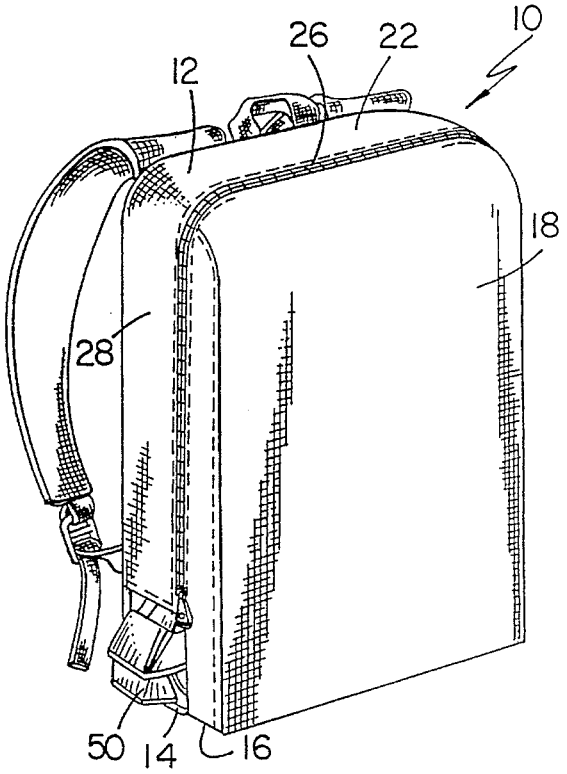
FIG. 4 is a perspective front view of the carrier bag in a closed position carrying a pair of in line skates.
Figure 5:
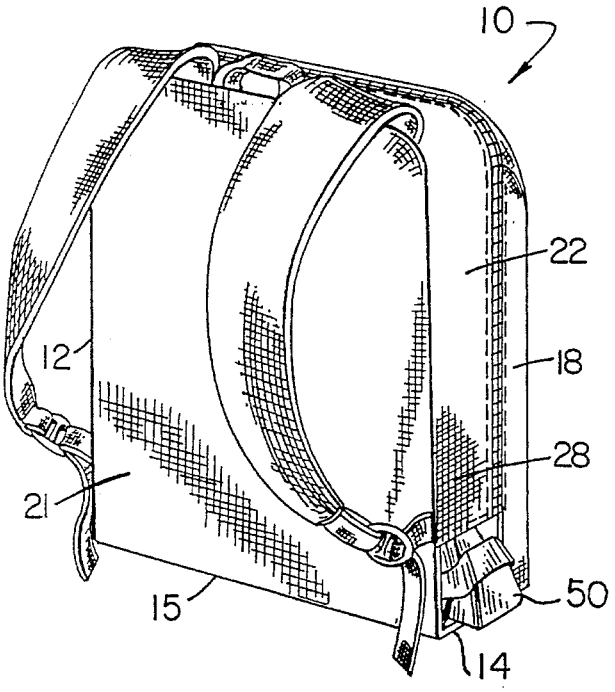
FIG. 5 is a perspective rear view of the carrier bag in a closed position carrying a pair of in line skates.
Figure 6:
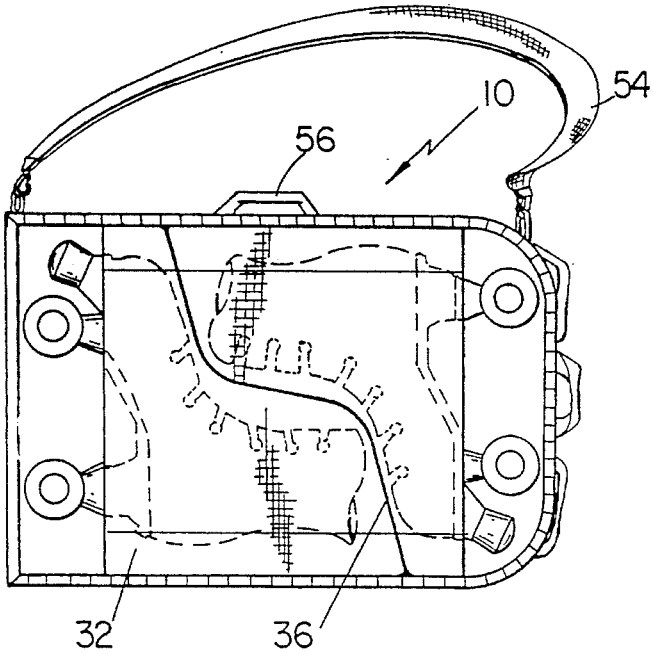
FIG. 6 is a front view of a second embodiment of the carrier bag carrying a pair of roller skates.
Figure 7:
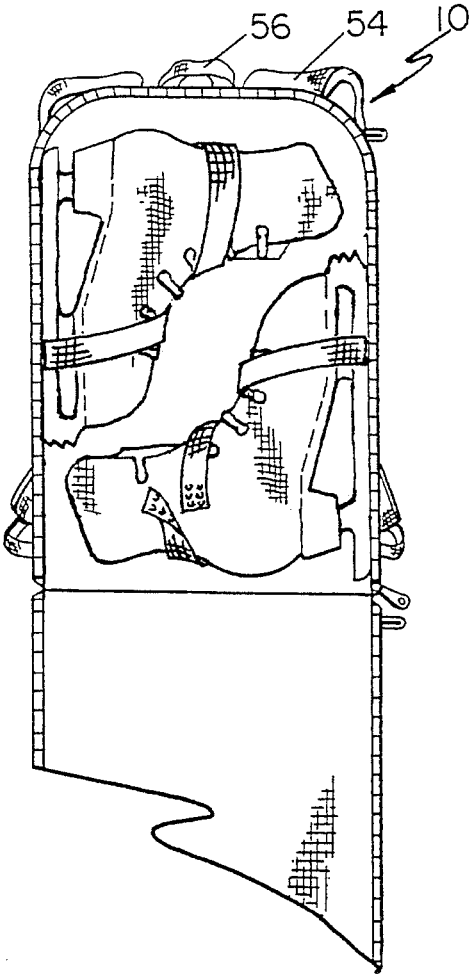
FIG. 7 is a front view a third embodiment of the carrier bag carrying a pair of ice skates.
Figure 8:
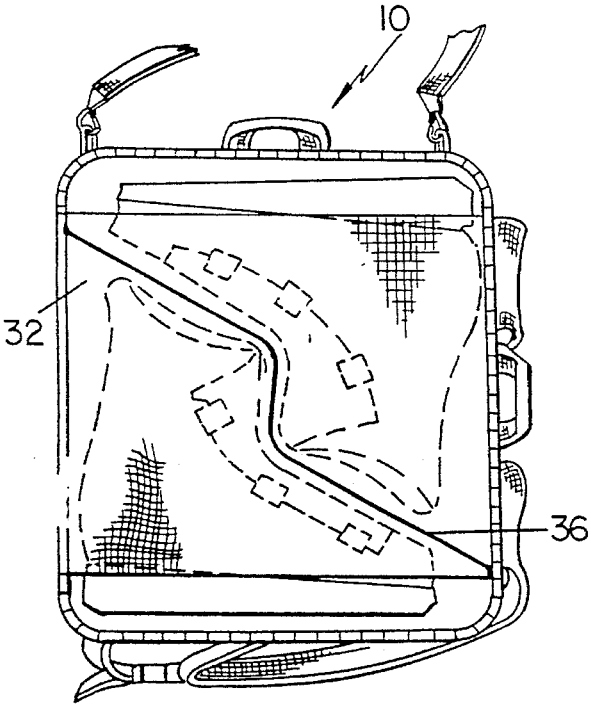
FIG. 8 is a front view of a fourth embodiment of the carrier bag carrying a pair of ski boots.

Turning in detail to the drawings, FIGS. 1–8 illustrate a carrier bag 10 for carrying athletic boots such as roller skates, in line skates, ice skates, ski boots, and the like. In FIG. 1, the bag 10 is shown in a closed position carrying a pair of in line skates (shown in phantom lines). The bag 10 is also illustrated in FIGS. 2 in an open position containing a pair of in line skates. However, although the bag 10 is initially described with respect to how it is used and designed to carry and accommodate a pair of in line skates, it is noted at the outset that the invention is not to be so limited. The concepts described herein are easily adapted to carry other types of athletic shoes and boots as illustrated in FIGS. 6–8 wherein the bag 10 is adapted to carry a pair of roller skates, ice skates and ski boots, respectively.

The bag 10 is made out of a sturdy, lightweight, flexible cloth such as canvas, nylon or other synthetic or natural fiber. As illustrated best in FIG. 2, the bag 10 is generally comprised of a compartment or container section 12 for holding the pair of athletic boots and a middle or connecting section 14 for connecting the container section 12 to a top or cover section 16 for closing the bag 10. The three sections can be constructed from one continuous piece of material, or several detachable portions of material which are sewn together or otherwise attached. They are shown here constructed primarily of two portions such that the connecting section 14 is a rectangular extension of the container 12.

As best illustrated in FIG. 5, the container 12 is comprised of a flat, rectangular base or floor 21 which serves as the bottom surface of the bag 10. The base 21 is surrounded on three sides by a boundary or wall 22 which includes a first side 24, a second side 26, and a third side 28 connected in series. The first side 24 serves as the right side wall of the bag 10 and is generally perpendicular to the second side 26 which serves as the top side wall of the bag 10 and is generally perpendicular to the third side 28 which serves as the left side wall. Each side has a bottom edge which is sewn or otherwise fastened to the base 21, and a top edge. The cover 16 is fastened to the connecting section 14 such that the base 21, connecting section 14, and cover 16 are an extension of eachother. A means for fastening the cover 16 over the container 12 is provided in the form of a zipper 30 positioned along the top edge of the boundary 22 which interconnects in a mating relationship with a zipper 30A secured along the edge of the cover 16. When the cover 16 is fastened to the container 12 (i.e., when the bag is closed) the connecting section 14 serves as the fourth side or bottom wall of the bag 10. The connecting section is comprised of a first seam or fold line 15 which allows the container 12 to bend or fold around the wheels of the in line skate and a second seam or fold line 17 which is formed where the container 12 is sewn to the cover 16. Other means for closing the bag 10 such as velcro, buttons, straps, and the like can be utilized in place of the zipper so long as they are capable of holding the cover 16 closed over the container 12.

The container 12 is designed to hold the pair of in line skates in a secure and compact position within the bag 10 and to prevent the individual shoes from shifting within the bag when the bag is closed. As illustrated best in FIG. 1, the container 12 is custom made to conform to the general shape of a pair of athletic boots when they are positioned on their side on the base 21 and upside down relative to eachother with the front, lace or buckle portion of the shoes 23 contiguously facing eachother. The shoes are also secured in the same plane such that the toes of one boot are held in position over or near the opening (foot entrance) of the second boot and vice versa. This configuration insures that the boots take up as little room as possible and that the bag is as small and compact as possible. Generally speaking, the shape of the bag 10 in a closed position, as defined by the four sides, is rectangular.

Figure 3:
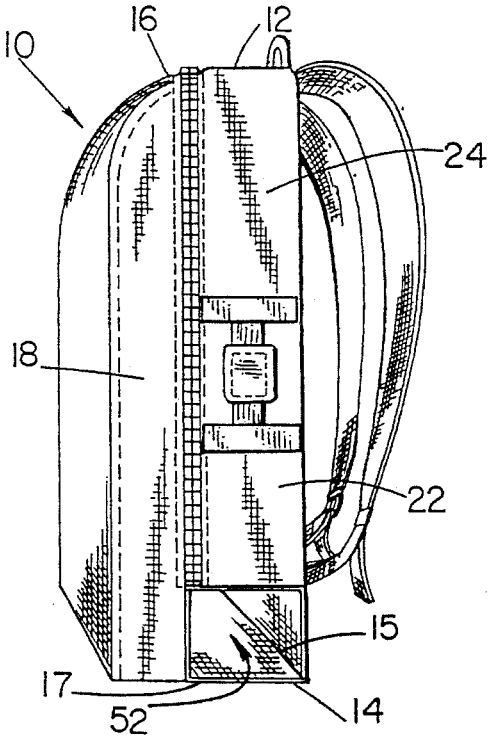
FIG. 3 is a perspective side view of the carrier bag in a closed position.

In the closed position, the minimum length of the bag 10 (the distance from the second side 26 to the fourth side 14) extends approximately from the wheels on one shoe 31 at the proximate end of the bag 10 to the wheels on the second shoe 33 at the distal end of the bag 10 when the two shoes are positioned as described (i.e., placing the shoes in an inverse and contiguous relationship to eachother). In addition, the minimum thickness or height of the bag 10 (the distance from the base 21 to the cover 16) can be as small as the approximate thickness of one of the shoes to be carried. The minimum width of the bag 10 (the distance from the first side 24 to the third side 28) is approximately the distance from the rear of the first boot to the rear of the second boot when the boots are placed in a contiguous, inverse relationship relative to eachother as illustrated in the drawings. (Of course, the boots can be positioned relative to different walls as illustrated in FIG. 7, in which case the minimum measurements should be considered appropriately. Since the actual measurements of the bag 10 can vary with the size of the boot or skate to be carried, two size bags are contemplated including one size to accommodate a pair of children's boots and a second size to accommodate a pair of adult's boots. Of course, as illustrated in FIGS. 2 and 3, an additional storage compartment or pocket 18 can be included on the outside face of the cover 16 to store various skating accessories and safety equipment such as an extra shirt, a pair of padded gloves, knee pads and the like. The addition of the storage pocket 18 will, of course, increase the overall thickness of the bag. Likewise, additional compartments can be included on the sides of the bag 10 or in other appropriate locations.

The bag measurments help to achieve one of the purposes and functions of the invention which is to hold the pair of athletic boots in a substantially nonshifting relationship (i.e., such that the individual boots remain substantially in the same plane without sliding on top of eachother or substantially rotating inside the bag 10). The minimum height of the boundary 22 (which is, for practical purposes, generally the same as the minimum thickness of the bag 10 in a closed position) extending from the base 21 to the zipper 26, is approximately the same as the thickness of one of the shoes to be carried therein and minimizes the amount of shifting of the in line skates in the forward and backward directions (i.e., towards the base 21 and the cover 16) when the bag 10 is closed. In addition to keeping the boots in one plane, the height of the boundary prevents the blade portion of the skates from banging against the back of the person wearing the bag in a knapsack position. Along the same lines, it prevents the skates from shifting into a position where the blade is pointing towards or protruding into the back of the person wearing the bag such that the wearer can be injured if, for example, the person were to fall.

The width of the bag 10 is such that it helps prevent the boots from rotating in a clockwise or counter-closkwise direction relative to the base 21 and from shifting horizontally. This is accomplished by positioning the heels and toes of the boots such that they are blocked either by the side walls of the bag 10 or the other boot. Along the same lines, the length of the bag 10 helps to prevent shifting in the longitudinal direction caused by gravity and other external forces on the boots because such motion is blocked by the second side 26 and the fourth side 14.

The positioning of the boots inside the bag 10 also serves to prevent the bag 10 from bending. The boots are placed in the bag 10 such that the blade portion on one boot extends horizontally across the top of the bag 10 (across the wearer's shoulders when the bag 10 is worn in the knapsack position) and the blade portion on the second boot extends horizontally across the bottom of the bag 10 (across the wearer's lower back when the bag 10 is worn is the knapsack position). In this way, the two blade portions on the respective boots act as a brace that prevents the bag 10 from bending. In addition, the weight of the boots is evenly distributed and the sharp and protruding portion of the boots are retained in a safe position relative to the wearer.

Alternative designs may include additional room on the interior of the bag 10 to allow other articles such as a towel, an extra pair of socks, a pair of padded gloves and other safety equipment and skating accessories to be strategically positioned inside the bag 10 relative to the shoes in order to prevent movement of the shoes. Furthermore, although a minimum thickness is defined, the maximum thickness of the boundary can vary to allow some movement of the skates so long as the blade portions of the skates are retained in a safe position and the skates are not permitted to "bounce" excessively.

The bag 10 is further comprised of a retainer 32 or other means for retaining or positioning the in line skates or shoes in a planar and an inverse relationship relative to eachother such that the laces of one shoe are facing the laces of the second shoe. This contiguous positioning of the shoes is necessary for two reasons. First, it positions the shoes such that they occupy the minimum amount of space necessary inside the bag 10. Second, it allows the blade portions of the boots (i.e., heavy and bulky portion of the shoes such as the wheels and brake on in line skates and the blades on ice skates) to be positioned in one of two prearranged blade locations so that they can be secured in place using a first blade guide or location 34 or a second blade guide or location 35.

As illustrated in FIGS. 1 and 2, the retainer 32 is a rectangularly shaped liner or sheet 32 sewn, zippered or otherwise connected to the top edge of the first wall 24 and the top edge of the third wall 28 of the container boundary 22 just below the zipper 26 and borders the respective blade guides 34, 35. The retainer 32 is comprised of four retainer walls respectively coinciding with the four boundary walls including a first retainer wall 42, a second retainer wall 44, a third retainer wall 46 and a fourth retainer wall 48. A curved flexible divider 36 extends from the bottom face of the liner 32 to the base 21, and from the upper end of the third wall 28 curving downward and across the base 21 to the lower end of the first wall 24, dividing the container 12 into a first pocket or section and a second pocket or section. The divider 36 is generally shaped to coordinate with the shape of the laced portion of the athletic boot to provide a place to rest the laced portion of each of the boots when they are placed in their respective pockets. The first pocket is defined by a substantial portion of the first wall 24, the second wall 26, a small portion of the third wall 28, the divider 36 and approximately one half of the base 21 (such as the portion extending from the divider to the upper right hand corner). The second pocket is defined by a substantial portion of the third wall 28, the fourth wall 14, a small portion of the first wall 22, the divider 36 and approximately one half of the base 21 (such as the portion extending from the divider to the lower left hand corner). Although FIGS. 1 and 2 illustrate one means for defining the retainer 32, a variety of other different shapes having different locations for their borders are possible. The liner 32 shown in FIG. 2 can also include a zipper (not shown) to provide respective flaps that open and provide easier access into the first and second pockets. Along the same lines, removeable liner can be provided using zippers, velcro, or the like to attach the liner to the boundary.

Access to the first and second pockets is provided via first and second engagement openings 38,40, respectively, formed at distal ends of the retainer 32. The first engagement opening is defined by the second boundary wall 26, a portion of the upper end of the third boundary wall 28, the second retainer wall 44, and a portion of the upper end of the first boundary wall 24. The second engagement opening is defined by the fourth retainer wall 48, the connecting portion 14, a portion of the lower end of the third boundary wall 28, and a portion of the lower end of the first boundary wall 24.

Although the retainer 32 shown in FIG. 1 illustrates a liner 32 that is sewn into the container, other means for securing the shoes in an inverse relationship to eachother are contemplated, For example, the liner 32 can be replaced with any number of strap configurations (not shown) such as a pair of straps secured to the base 21 (i.e., one positioned near the toe of each shoe and a second positioned near the ankle of each shoe) so long as they are capable of holding the shoes in place. The straps are easily secured in position using a velcro or buckle configuration as is well known in the art. Furthermore, the cover 16 can also serve as the retainer in place of the liner or sheet.

As illustrated in FIGS. 1, 4, and 5, in line skates typically have only one brake 50 which is aligned with and protrudes from the rear of the wheels on one of the shoes. When the cover 16 is placed over the container 12 the connecting portion 14 wraps around the wheels such that the brake 50 is left protruding outside the bag 10 through a brake guide or opening 52 defined by the base 21, the connecting portion or fourth wall 14, the cover 16 and at least one of either the first wall 24 or the third wall 28 when the bag is in a closed position. Thus, the length of the connecting portion 14 must be sufficient to wrap around the wheels or brakes and allow the cover 16 to be secured to the container 24. This length may vary depending on the type, shape or size of the shoe. The distance can be measured, for example, such that the distance from the fourth wall 14 to the retainer fourth wall 48 is approximately equal to the distance from the sole of the boot to the bottom of the blade portion. Generally speaking, any range of measurements will be sufficient so long as there is enough material to wrap around the blade portion, secure the boots in their secured position and move the cover 16 into position to be zippered shut in a closed position.

The cover 16 is a flat, rectangular section of material having a zipper 26A for interconnecting with the zipper 26 on the container 12. When the cover 16 is placed in position over the container 12 it pulls the connecting portion 14 securely around the blade portion of the in line skate while leaving the brake 50 outside the bag 10 and forces the boot up into the second engagement opening 40 such that the lace portion of the shoe rests against the curved divider 36. The in line skate without the brake is positioned in the first pocket such that the blade portion is pressed against the second wall 26 or top boundary. The advantage of wrapping the fourth wall 14 around the blade portion is that it leaves the brake 50 outside the bag 10 resulting in a smaller more compact bag. It should be noted, however, that where the athletic boot does not have a protruding brake, the brake guide can be eliminated and the bag 10 designed accordingly such as illustrated in FIGS. 6–8.

As illustrated in FIGS. 1–8, shoulder straps 54 and/or handles 56 may be attached to the bag 10 to allow the bag 10 to be carried like a knapsack, purse, or briefcase. In addition, the handles 56 and straps 54 can be provided as detachable items. The handles 56 also provide a convenient location for attaching a safety helmet when the helmet is not being worn.

As illustrated in FIGS. 6, 7, and 8, respectively, the carrier bag 10 can accommodate a pair of roller skates, ice skates, or ski boots such that the blade portion of the skates (i.e., the wheels, blades, and ski locks, respectively) are positioned at opposite ends of the bag 10. It should be noted that the blade portions of the athletic boots are not necessarily required to be positioned across the top and bottom walls (the second side and fourth side) in order to be comfortably balanced. For example, as illustrated in FIG. 7, the blade portion of the boots can be positioned along the two side walls (the first side and third side).

Thus, a carrying bag for a pair of athletic boots is disclosed which will comfortably hold a pair of athletic boots in a nonshifting, planar and/or inverse relationship to eachother. The carrying bag disclosed will allow the skater to skate while carrying a pair of walking shoes and other skating equipment safely on his back and while leaving his hands free. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A backpack having an internally divided, custom shaped compartment used for securing a pair of athletic boots in a stationary and inverse relationship relative to each other comprising:

an interior compartment defined by a substantially rectangular base surrounded by a boundary comprising a first, second, third and fourth wall connected in series along the perimeter of said base;

a rectangular shaped retainer extending parallel to said base and connecting said first and third walls of said boundary thereby forming a first opening with said second wall at one end of the base to receive one of a pair of athletic boots and a second opening at the opposite end of said base with the fourth wall for receiving a second of a pair of athletic boots;

a divider connected to said retainer and said base to divide the interior compartment into two distinct pockets such that each pocket is accessible only by the first or second opening;

a cover for closing the interior compartment to form a custom shaped container capable of securely holding the pair of athletic boots in a close, non-moving inverse relationship relative to each other; and at least two shoulder straps secured to the base or boundary for carrying said container.

2. A backpack having an internally divided, custom shaped compartment used for securing a pair of athletic boots in a stationary and inverse relationship relative to each other comprising:

an interior compartment defined by a substantially rectangular base at least partially surrounded by a boundary comprising a first, second and third wall connected in series along the perimeter of said base;

a retainer extending between said first and third walls opposite each other and being substantially parallel to said base to form a first opening with said second wall at one end of the base for receiving one of a pair of athletic boots and a second opening with said base, first and third wall at the opposite end of said base for receiving a second of a pair of athletic boots;

a divider connected to said retainer and said base to divide the interior compartment into two distinct pockets such that each pocket is accessible only by the first or second opening;

a cover that extends from said base around said second opening to secure said pair of athletic boots in their respective openings, wherein said cover and compartment are custom shaped to securely hold the pair of athletic boots in a close, non-moving inverse relationship relative to each other; and at least two shoulder straps secured to the base or boundary for carrying said container.

3. A backpack having an internal compartment, custom shaped to secure a pair of athletic boots in a stationary and inverse relationship relative to each other comprising:

an interior compartment defined by a substantially rectangular base surrounded by a boundary comprising a first, second, third and fourth wall connected in series along the perimeter of said base;

a first pair of straps connected to said base or boundary inside said compartment to secure one of a pair of athletic boots inside said compartment such that one strap is positioned to wrap around the ankle portion of said boot and the other is positioned to wrap around the foot portion of said boot;

a second pair of straps connected to said base or boundary inside said compartment to secure the other of a pair of athletic boots inside said compartment such that one strap is positioned to wrap around the ankle portion of said boot and the other is positioned to wrap around the foot portion of said boot and wherein said first and second pair of straps are capable of securely holding the pair of athletic boots in a close, non-moving inverse relationship relative to each other; and at least two shoulder straps secured to the base or boundary for carrying said container.

4. A backpack according to claim 1, 2 or 3 further comprising a pocket formed on the inside portion of said cover designed to hold safety equipment, skating gear or clothing.

5. A backpack according to claim 1, 2 or 3 further comprising a pocket formed on the outside portion of said cover designed to hold safety equipment, skating gear or clothing.

6. A backpack according to claim 1, 2 or 3 wherein said base is padded to protect the back of the wearer.

* * * * *